United States Patent [19]

Wiknich

[11] 4,159,704

[45] Jul. 3, 1979

[54] ARTICULATED, SPRING-CONTROLLED INTAKE VALVE

[75] Inventor: Harold V. Wiknich, Warren, Mich.

[73] Assignee: General Motors Corporation, Detroit, Mich.

[21] Appl. No.: 892,775

[22] Filed: Apr. 3, 1978

[51] Int. Cl.[2] ..... F01L 3/00; F01L 7/00

[52] U.S. Cl. ..... 123/188 AP; 123/81 B; 123/188 B; 251/303

[58] Field of Search ..... 123/30 C, 81 R, 81 B, 123/188 R, 188 B, 188 S, 188 AP, 188 M; 251/299, 303

[56] References Cited

U.S. PATENT DOCUMENTS

| | | | |
|---|---|---|---|
| 1,397,585 | 11/1921 | James | 123/79 |
| 1,542,617 | 6/1925 | Guy et al. | 123/81 B |
| 1,988,018 | 1/1935 | Peterson | 123/188 AP |
| 3,013,582 | 12/1961 | Eibl | 251/303 |
| 3,299,869 | 1/1967 | Sicklesteel | 123/188 AP |
| 3,875,921 | 4/1975 | DeBoy et al. | 123/188 AP |
| 3,878,825 | 4/1975 | Klomp | 123/188 S |
| 3,989,015 | 11/1976 | Riuere | 123/188 B |

FOREIGN PATENT DOCUMENTS

| | | | |
|---|---|---|---|
| 970490 | 9/1958 | Fed. Rep. of Germany | 123/188 AP |
| 562864 | 5/1957 | Italy | 123/188 B |

*Primary Examiner*—Charles J. Myhre
*Assistant Examiner*—David D. Reynolds
*Attorney, Agent, or Firm*—Arthur N. Krein

[57] ABSTRACT

An articulated, spring-controlled intake valve, for use in controlling induction flow through an intake port of an induction passage in an internal combustion engine, includes a valve head and a separate valve stem connected together by a hinge member with one end thereof pivotally secured to the valve stem and its opposite end fixed to the valve head with one end of a flexure spring sandwiched therebetween, the opposite end of the flexure spring being secured by a clamp member to an internal wall defining a portion of the induction passage.

3 Claims, 2 Drawing Figures

ARTICULATED, SPRING-CONTROLLED INTAKE VALVE

FIELD OF THE INVENTION

This invention relates to valves for internal combustion engines and, in particular, to an articulated, spring-controlled intake valve for use in such engines.

DESCRIPTION OF THE PRIOR ART

Intake or induction valves for internal combustion engines are normally of the poppet valve type in which the valve has an annular head adapted to seat against a valve seat in the cylinder head of the engine to control the flow of induction fluid from the intake manifold through an inlet port, defined in part by the valve seat, to the cylinder of the engine during the induction cycle for that cylinder of the engine and, an integral stem extending from the head of the valve concentric therewith, this stem being reciprocably journaled in the cylinder head of the engine with one end of the stem extending from the cylinder head for engagement by suitable means, such as a rocker arm or cam, to effect reciprocating movement of the valve head in a direction in line with the common axis of the stem and head of such a valve.

In such a conventional poppet valve, when the head is unseated from the valve seat, a uniform annular flow area is provided between the valve head and the inlet port for the flow of induction fluid into the cylinder or combustion chamber of the engine. With such an arrangement, induction fluid flow is substantially uniform around the head of the valve and, accordingly, depending on the location of the inlet port relative to the longitudinal axis of the cylinder, there is little or no swirling motion of the induction fluid entering the cylinder around the longitudinal axis of the cylinder.

Because of this, various means have been used in the prior art to promote swirl of the induction fluid on entry into the combustion chamber, such as by the use of a shrouded valve or a swirl port. For example, by providing the outer surface of the valve guide in the inlet port with suitable shaped ribs or vanes, induction fluid entering the cylinder from this port is given a direction of flow which, in general, is the desired direction of induction fluid flow rotation around the axis of the cylinder. However, it has been found that whether a shrouded valve or a swirl port is used to introduce swirl, the use of such a swirl inducing device will effect a reduction in the volumetric efficiency of the engine. Furthermore, the use of either a shrouded valve or a swirl port is not readily adaptable for use in a split manifold type engine.

The desirability of providing a poppet valve structure to overcome the above described problems has been recognized and has resulted in the provision of poppet inlet valve structures of the type wherein the head of the valve can be moved axially and at the same time pivoted relative to its valve seat whereby induction fluid can flow through an inlet port encircled by the valve seat, such a valve structure being of the type disclosed, for example, in U.S. Pat. No. 3,875,921 entitled "Articulated, Spring-Controlled Intake Poppet Valve" issued Apr. 8, 1975 to Gail R. DeBoy, Edward D. Klomp and George H. Stoughton.

SUMMARY OF THE INVENTION

The present invention relates to an intake valve for an internal combustion engine, the valve having a head articulated relative to its stem as by being connected thereto by a hinge member that is pivotally secured to the stem and rigidly fixed to the head, a flexure spring being secured to the head and to a wall defining in part, an induction passage of the engine, so that when the head is in seated relation to a valve seat encircling an associated inlet port of the engine, the flexure spring is flexed so that during opening movement of the head it will follow the deflection angle of the flexure spring.

It is therefore a primary object of this invention to provide an improved articulated, spring-controlled intake valve for use in an internal combustion engine that is operative to provide improved control of air flow during induction fluid intake.

Another object of this invention is to provide an improved articulated intake valve structure that includes a head pivotally movable during valve opening by means of a flexure spring.

A still further object of this invention is to provide an inlet valve and intake port structure having an improved intake valve-port flow coefficient.

For a better understanding of the invention, as well as other objects and further features thereof, reference is had to the following detailed description of the invention to be read in connection with the accompanying drawings wherein:

DESCRIPTION OF THE PREFERRED EMBODIMENT

Figure 1:
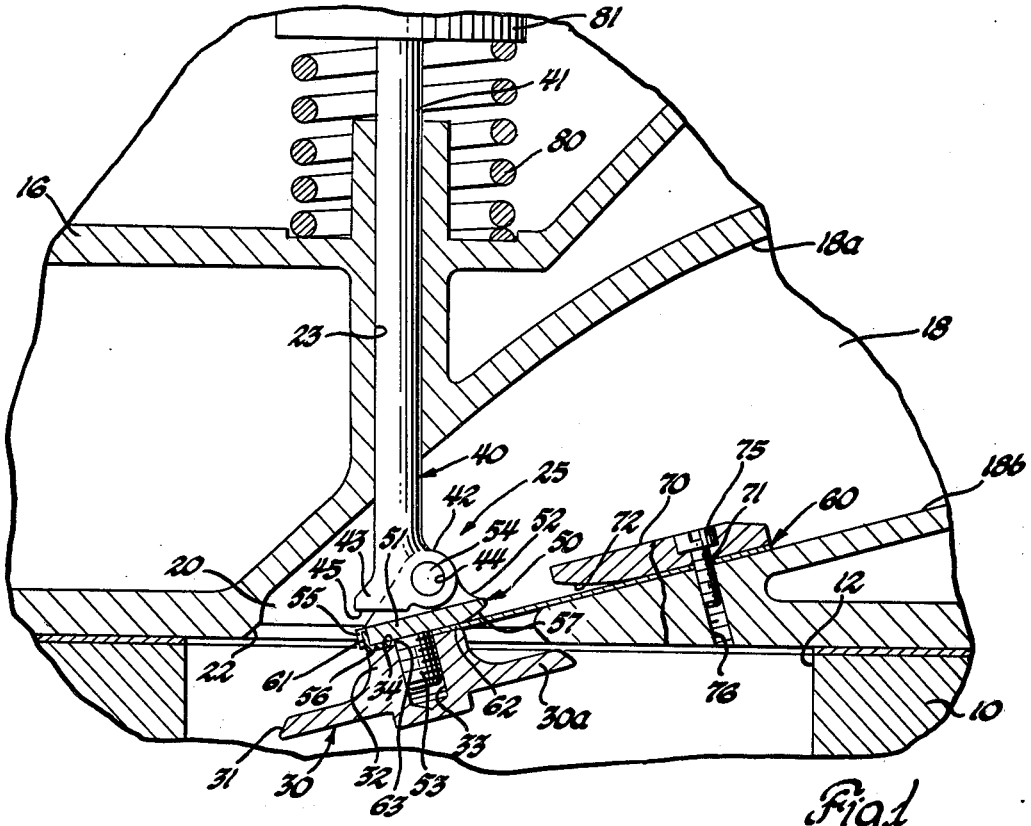
FIG. 1 is a sectional view of a portion of an internal combustion engine having an articulated, spring-controlled intake valve in accordance with the invention, positioned to control the flow of induction fluid into the combustion chamber of the engine, the valve being shown in its open position.

Referring now to the drawings, there is illustrated a portion of an internal combustion engine having an engine cylinder block 10 with a cylinder bore 12 therein reciprocably receiving a piston 14 to define a combustion chamber, the cylinder bore being partly closed at one end by a cylinder head 16 suitably secured to the cylinder block. The cylinder head 16 is provided with an induction passage 18 terminating at an intake or inlet port 20. Inlet port 20 presents an annular valve seat 22 which, as is well known, is chamfered or beveled at a suitable angle to the axis of the inlet port, as desired, on the side of the cylinder head adjacent to cylinder block 10. Induction passage 18, as is well known, is curved in its longitudinal direction at least closely adjacent to the inlet port thereof to change the direction of induction fluid flow therethrough so that fluid flow is directed downward toward the combustion chamber. As shown, the induction passage 18 is formed in part by an internal upper wall **18*a* of the cylinder head providing an outside bend and an internal lower wall 18*b*** of the cylinder head providing an inside bend.

Referring now to the articulated, spring-controlled intake valve of the invention, this valve, generally designated 25 is a multi-piece unit and includes a valve head 30, a valve stem 40 and a hinge member or valve hinge 50 suitably securing the valve head to the valve stem in a manner to be described whereby the valve head 30 can pivot relative to the valve stem 40.

Figure 2:
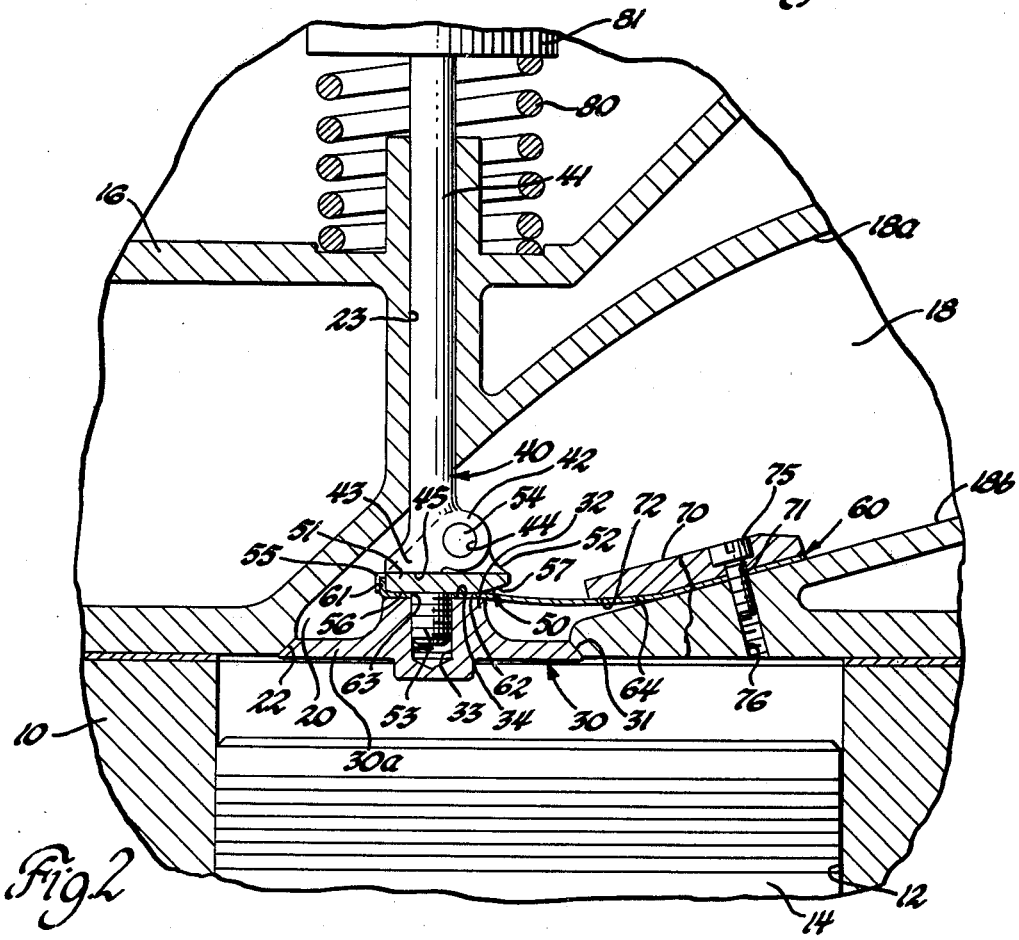
FIG. 2 is a view similar to that of FIG. 1 but showing the subject intake valve in its closed position.

Valve head 30, of circular configuration and formed as a body 30*a* of revolutions about an axis, is provided with an annular valve seat face or surface 31 on its back side that is sized and formed complementary to the valve seat 22 against which it seats when in its closed position relative thereto, as shown in FIG. 2, and is provided with an upstanding boss 32 extending upward from the back side of the main body 30*a* portion concentric with seat surface 31. The boss 32 is provided with a central, internally threaded bore 33 extending from the upper free surface 34 of the boss.

The valve stem 40, of inverted, blunt T-shape, includes a stem 41 which terminates at its lower end, with reference to the Figures, in a stem head 42. As shown, the stem 41 is of predetermined external diameter whereby this stem is slidably received in a through stem guide bore 23 provided in the cylinder head 16 coaxial with the axis of the inlet port 20. Stem head 42 is of a longitudinal extent substantially greater than the diameter of the stem 41 and it is formed with flat sides 43 spaced apart a distance at least equal to but preferably slightly greater than the external diameter of stem 41 for a purpose which will become apparent. Stem head 42 is also provided with a cross bore aperture 44 on one end thereof at a predetermined spaced distance from the axis of stem 41 and, on its opposite end, the stem head 42 is provided with a lower flat stop surface 45 preferably formed at right angles to the axis of stem 41.

Valve hinge 50 includes a base 51 with parallel spaced apart pivot legs 52 extending upward from one side thereof and with an externally threaded screw fastener 53 depending from the opposite side thereof, the screw fastener 53 being sized for threaded engagement into the threaded bore 33 of the valve head 30. Each of pivot legs 52 is provided with a through aligned aperture of a diameter corresponding to the diameter of the aperture 44 whereby these apertures suitably receive a pivot pin 54 used to pivotally secure the valve hinge 50 and therefore the valve head 30 to the valve stem 40. For a purpose which will become apparent, the base 51 is preferably provided with a recessed notch 55 at the one end thereof adjacent to the apertures in the pivot legs 52 and the lower surface of the base 51 next adjacent to the screw fastener 53 and extending over to the notch 55 is formed flat as at 56, while this lower surface adjacent to the end of the base opposite notch 55 is formed with a predetermined upward sloping curvature, as at 57, for a purpose which will become apparent. As shown, the upper surface of the base 51 is substantially flat to provide an abutment surface at least at one end thereof for engagement by the stop surface 45 of valve stem 40. To effect controlled pivotal movement of the valve head 30 relative to the valve stem 40 and therefore relative to the axis of the inlet port 20 during opening and closing movement of the valve head 30 relative to valve seat 22, there is provided a flexure spring 60 which is fixed at one end to the internal wall 18*b* of the cylinder head 16 as by a spring clamp 70 and which has its opposite end operatively connected to the valve head 30.

Flexure spring 60, made of suitably flat spring material, is provided with an upturned lip 61 at one end thereof which is of a suitable width whereby it can be received into the recessed notch 55 of the valve hinge 50 when assembled thereto, as shown, an intermediate flat portion 62 provided with an aperture 63 therethrough of a size to loosely receive the screw fastener 53 and a prebent curved portion 64 integral with an extending upward from the intermediate flat portion 62 in the same direction as lip 61, as shown in FIG. 2.

The flexure spring 60, as assembled to the valve hinge 50 and valve head 30 and to the cylinder head 16, has its flat portion 62 securely sandwiched between the lower surface of the valve hinge 50 and the upper surface 34 of the valve head 30, with the screw fastener 53 extending through the aperture 63 into threaded engagement with the threaded bore 33 in the valve head 30. Engagement of the lip 61 into the recessed notch 55 of the valve hinge 50 prevents rotation of the flexure spring relative to the valve hinge. The opposite end of the flexure spring 60, adjacent to the free end curved portion 64 thereof, is secured to the lower wall 18*b* of the cylinder head 16 as by being sandwiched between the spring clamp 70 and this wall. As shown, the spring clamp is suitably secured to the cylinder head 16 as by spaced apart screws 75 extending through apertures 71 in the spring clamp for threaded engagement into suitably threaded apertures 76 provided for this purpose in the cylinder head 16. The screws 75 are suitably spaced apart relative to each other whereby to receive the flexure spring 60 therebetween. As shown, the lower surface of the spring clamp 70 at its downstream end, relative to the direction of fluid flow through the induction passage 18, is curved upward, as at 72, away from the lower wall 18*b* to permit limited upward movement of the flexure spring relative to the lower wall 18*b*.

As conventional, the upper end of the stem 41 of valve stem 40 extends outward from the cylinder head 16 for actuation, in one axial direction to effect opening of the intake valve 25, by means of a suitable valve actuator mechanism, such as a rocker arm or cam, not shown, engaging the free end of the stem 41. Axial movement of the valve stem 40 in the opposite direction to effect valve closing is affected in a conventional manner by a return spring 80 abutting at one end against the top of cylinder head 16 and at its other end abutting against a suitable spring retainer 81 secured in a conventional manner to the stem 41.

Operation

During engine operation, the intake valve 25 is normally held in the closed position shown in FIG. 2 by the return spring 80 which is operative to hold the valve head 30 in position whereby its valve seat surface 31 engages the valve seat 22.

When the valve stem 40 is actuated to effect axial movement downward, to the position shown in FIG. 1, the driving engagement of the pivot pin 54 carried by the valve stem 40 with the valve hinge 50 will effect a downward or lift movement of the valve head 30, which is moved axially downward and also pivoted to the position shown in this figure so that the final opening area between the valve seat 22 and valve seat surface 31 will be greater on one side of the inlet port 20 than on the other side. Thus, with reference to FIG. 1, the flow area on the left side of the inlet port 20 is substantially greater than on the right side.

As will be apparent from the construction shown, the hinging action of the valve head 30 is controlled by the flat flexure spring 60. As described, this flexure spring is formed so that a force is exerted to hold the valve head 30, through the valve hinge 50 against a mechanical stop, which in the embodiment shown, is the flat stop surface 45 of the valve stem 40, to assure straight line motion, that is, axial movement only, during the initial valve head opening period of the valve lift cycle. This initial action of the valve head 30 results in a smooth, controlled unseating of the valve head 30 from the valve seat 22 and ensures that no rubbing will occur between the valve seat surface 31 and the valve seat 22. After the valve head 30 has passed the unseating period of motion, the flexure spring 60 becomes unloaded at its free end, the end sandwiched between valve head 30 and valve hinge 50, and then acts as a leaf spring that is fixed at one end only, and thus serves as a flexure member. Since the valve head 30 is attached to the free end of the flexure spring 60, it will follow the deflection angle of this spring member. This action results in a uniform change of the angular relationship of the valve head 30 to the axis of the valve stem 40 during the balance of the lift cycle.

The above-described hinging action of the valve head 30 generates a final opening area pattern that is greater at one side of the inlet port than at the other side thereof. Since the pivot pin 54 is located above the valve seat surface 31, the valve head 30 will swing off-center of the axis of the inlet port 20 opening and provide additional exit area at the side where the flow area is already increased. The location of the pivot pin 54 is suitably established, as desired, to maintain a constant length of the flexure spring 60 during the hinging action of the lift cycle so as to eliminate side loading of the valve stem 40 in its guide bore 23.

After the intake valve 25 has completed its lift cycle to the position shown in FIG. 1, the conventional valve spring 80 will then be operative to pull the valve stem 40 and the valve head 30 back toward the seating position of the valve head against the valve seat 22. During this valve closing movement, the valve head 30 will follow the deflection angle of the flexure spring 60 until it again reaches its mechanical stop on the valve stem 40, that is, until the upper surface of the valve hinge 50 abuts against the flat stop surface 45 of valve stem 40. Then, during the final closing period, the flexure spring 60 again holds the valve head 30 in its stop position assuring straight line motion thereof until the valve head 30 is again seated against the valve seat 22, whereby a smooth, controlled seating of the valve head is effected.

It will thus be apparent that the articulated, spring-controlled intake valve 25 is operative during valve lift whereby the head 30 of this valve is swung downward and away from the intake or inlet port 20 opening so as to direct the induction fluid flow into the combustion chamber with resulting fluid motions which would be advantageous to combustion and charge stratification as by producing strong combustion chamber swirl generation. Furthermore, by providing increased opening area for a given valve lift with improved geometry of the flow area will provide for smooth directional control of inlet induction flow and improved engine breathing or volumetric efficiency due to an improved intake valve-port flow coefficient.

The embodiments of the invention in which an exclusive property or privilege is claimed are defined as follows:

1. A valve controlled induction system for an internal combustion engine including a cylinder head having an induction passage therein terminating at an annular beveled valve seat defining an inlet port to a combustion chamber on the combustion side of the cylinder head, a through stem guide bore in said cylinder head opening into said induction passage concentric with said valve seat, a valve stem reciprocably journaled in said stem guide bore, a flexure spring of flat spring material, a clamp means fixed to said cylinder head within said induction passage with one end of said flexure spring secured between said clamp means and said cylinder head, a valve head, and a hinge means, said hinge means having one end thereof pivotally connected to said valve stem off-center of the axis thereof and having its opposite end fixed to said valve head, with the opposite end of said flexure spring sandwiched therebetween, whereby said valve head is positioned for movement upon reciprocation of said valve stem between a closed position at which said valve head is in seated engagement with said valve seat and an open position at which said valve head is in pivoted and axially spaced-apart relation relative to said valve seat.

2. An articulated, spring-controlled intake valve for use in controlling induction fluid flow through an intake port at the downstream end of an induction passage in the cylinder head of an engine, said intake valve including a valve stem having an axial extending stem portion positionable for reciprocating movement in the cylinder head, a valve head means, pivot means pivotally securing said valve head means to said valve stem for pivotal movement about a pivot axis spaced a predetermined off-set distance from the axis of said stem portion, and a flexure spring of flat spring material fixed at one end to said valve head means a predtermined distance from the pivot axis of said pivot means and adapted to be fixed at its other end to the cylinder head within the induction passage therein upstream of the intake port in terms of fluid flow through the induction passage.

3. An articulated, spring-controlled intake valve for use in controlling induction fluid flow through an intake port at the downstream end of an induction passage in the cylinder head of an engine, said intake valve including a valve stem having an axial extending stem portion adapted for reciprocating movement in the cylinder head and a stem head at one end of said stem portion, a valve hinge, a pivot means pivotally securing said valve hinge at one end thereof to said stem head for pivotal movement about an axis spaced a predetermined off-set distance from the axis of said stem portion, a flexure spring of flat spring material, and a valve head, said valve head being operatively fixed to the opposite end of said valve hinge with one end of said flexure spring sandwiched therebetween, said flexure spring being adapted to be fixed at its other end to the cylinder head within the induction passage therein upstream of the intake port, whereby said flexure spring is operative to control the pivotal movement of said valve hinge and therefor of said valve head relative to said valve stem during valve opening and closing axial movement of said valve stem.

* * * * *